US006080926A

United States Patent [19]

Matsuda

[11] Patent Number: 6,080,926

[45] Date of Patent: Jun. 27, 2000

[54] AUTOMATIC ACCOMPANYING APPARATUS AND AUTOMATIC ACCOMPANYING METHOD CAPABLE OF SIMPLY SETTING AUTOMATIC ACCOMPANIMENT PARAMETERS

[75] Inventor: Toshinori Matsuda, Shizuoka-ken, Japan

[73] Assignee: Kabushiki Kaisha Kawai Gakki Seisakusho, Hamamatsu, Japan

[21] Appl. No.: 09/318,509

[22] Filed: May 25, 1999

[30] Foreign Application Priority Data

May 28, 1998 [JP] Japan ..... 10-148068

[51] Int. Cl.[7] ..... G10H 1/40; G10H 5/00

[52] U.S. Cl. ..... 84/667; 84/610; 84/611; 84/634; 84/635; 84/650; 84/651; 84/666

[58] Field of Search ..... 84/609–611, 613, 84/634–635, 637, 649–651, 666–667, 669

[56] References Cited

U.S. PATENT DOCUMENTS 5,461,192 10/1995 Imaizumi ..... 84/634
5,712,436 1/1998 Sakama et al. ..... 84/610
5,831,195 11/1998 Nakata ..... 84/609
5,942,710 8/1999 Hayakawa et al. ..... 84/637

*Primary Examiner*—Paul Ip
*Assistant Examiner*—Marlon T. Fletcher
*Attorney, Agent, or Firm*—Christie, Parker & Hale, LLP

[57] ABSTRACT

In an automatic accompanying apparatus and an automatic accompanying method, the respective part structures of a plurality of basic variation patterns used as a basic accompanying pattern of rhythm are arbitrarily set by a music player. When the music player selects one basic variation pattern from a plurality of basic variation patterns to which the part structures are set in such a manner, the part structure is automatically set in such a manner that part structures of an intro-pattern, an ending pattern, and also a fill-in pattern, which are prepared for this rhythm, are made equal to the part structure of the selected basic variation pattern. The automatic accompaniment is carried out by employing the selected basic variation pattern, and the intro-pattern, ending pattern, and fill-in pattern, which own the same part structures as that of this basic variation pattern. As a result, the automatic accompaniment can be carried out while being matched with a motif of a user through the entire music. Moreover, the parameter setting operation executed before starting the musical play can be simplified.

18 Claims, 12 Drawing Sheets

Fig. 3

ALLOCATION OF WORK MEMORY

| |
|---|
| AUTOMATIC MUSICAL PLAYING FLAG:AUTO |
| EDIT FLAG:EDIT |
| EDIT PART REGISTER |
| RHYTHM NUMBER REGISTER |
| BASIC NUMBER REGISTER |
| BASIC-1-PART STRUCTURE REGITER |
| BASIC-2-PART STRUCTURE REGITER |
| BASIC-3-PART STRUCTURE REGITER |
| BASIC-4-PART STRUCTURE REGITER |
| FILL-IN NUMBER REGISTER |
| CURRENT PART STRUCTURE REGISTER |
| CLOCK COUNTER |
| CHECK TIMING COUNTER |
| STEP TIME COUNTER:COUNT |
| DRUM PART ADDRESS REGISTER |
| BASS PART ADDRESS REGISTER |
| ACC1 PART ADDRESS REGISTER |
| ACC2 PART ADDRESS REGISTER |
| ACC3 PART ADDRESS REGISTER |
| CURRENT PART POINTER |
| ⋮ |

TIMER INTERRUPT PROCESS OPERATION

AUTOMATIC ACCOMPANYING APPARATUS AND AUTOMATIC ACCOMPANYING METHOD CAPABLE OF SIMPLY SETTING AUTOMATIC ACCOMPANIMENT PARAMETERS

BACKGROUND OF THE INVENTION

1. Field of the Invention

The present invention is related to an automatic accompanying apparatus and an automatic accompanying method, and more specifically, to a technique capable of simplifying a setting operation required for performing an automatic accompaniment method with motifs of music players.

2. Description of the Related Art

In currently available electronic musical instruments, for instance, electronic keyboards, electronic organs, and electronic pianos, automatic accompanying apparatuses are introduced. A typical automatic accompanying apparatus executes an automatic accompaniment with using one rhythm selected from a plurality of rhythm. While such an automatic accompanying apparatus is employed, any users may perform melody musical plays and also chord musical plays in combination with automatically produced accompaniment sounds. An accompaniment pattern of each rhythm contains a basic pattern and an auxiliary pattern. This basic pattern constitutes a basic accompaniment pattern of rhythm. The basic pattern contains two to six sorts of variation patterns. A variation about one basic pattern is called as a basic variation pattern. Also, an auxiliary pattern corresponds to an auxiliary accompaniment pattern used to apply a change to an automatic accompaniment. This auxiliary pattern contains a fill-in pattern, an intro-pattern, and an ending pattern. Generally speaking, one sort of accompaniment pattern is prepared as an intro-pattern and an ending pattern with respect to each rhythm. To the contrary, a fill-in pattern contains plural variations, the number of which is equal to that of the variations of the above-explained basic patterns. Each of these plural variations is referred to as a fill-in variation.

Furthermore, each pattern of the above-described basic variation, fill-in variation, intro-variation, and ending variation is arranged by a plurality of musical parts such as a drum, a bass, an ACC1, and ACC2, and an ACC3. In this case, a drum part produces a drum sound. A bass part produces a bass sound. Each of an ACC part 1, an ACC part 2, and an ACC part 3 produces a chord sound and a melody sound. A part structure of each basic variation pattern, and each fill-in variation pattern is set in such a manner that a desirable part contained in the plural parts is muted by employing an operation panel.

In the case that the automatic accompaniment is carried out by this automatic accompanying apparatus, a user first selects desirable rhythm from a plurality of rhythm. Next, this user selects one basic variation pattern which is fitted to a motif of a music player from a plurality of basic variations related to the selected rhythm. Similarly, the user selects one fill-in variation pattern that is fitted to the motif of this music player from a plurality of fill-in variations related to the selected rhythm. The respective intro-pattern and ending pattern are automatically selected by selecting the desirable rhythm. Furthermore, the music player changes the respective part structures of the selected basic variation patterns and of the selected fill-in variation patterns so as to be fitted to the motif of this music player. When an intro-switch is depressed after the above-explained setting operation has been accomplished, the intro-musical play constructed of several musical phrases is commenced with the intro-pattern corresponding to the selected rhythm. Then, when this intro-musical play is ended, the basic musical play is repeatedly carried out with the previously selected basic variation pattern. When a fill-in switch is depressed while this basic musical play is repeated, the fill-in musical play constructed of only several musical phrases is carried out with the previously selected fill-in variation pattern. Thereafter, the basic musical play is again carried out. Then, while the basic musical play is carried out, when the ending switch is depressed, the ending musical play constructed of several musical phrases is carried out with the ending pattern corresponding to this rhythm. Thereafter, this automatic accompaniment is stopped.

The above-described conventional automatic accompanying apparatuses has the following problems. That is, even when the part structure of the basic variation pattern is changed so as to be matched with the motif of the musical player, the respective part structures of the intro-pattern and the ending pattern are not changed. As a result, the continuity between the intro-musical play and the basic musical play, and furthermore, the continuity between the basic musical play and the ending musical play will become unnatural. For example, even when the musical player mutes the ACC1 part and the ACC2 part in order to execute the quiet automatic accompaniment, both the ACC1 part and ACC2 part of the intro-pattern and the ending pattern are not muted. As a result, although the basic musical play is performed under quiet condition, since both the intro-musical play and the ending musical play are carried out under exciting condition, the overall musical play would become unnatural.

Also, a musical player may possibly change a basic variation pattern under use into another basic variation pattern that is matched with a motif of this musical player while a musical play is carried out. In this case, a fill-in variation pattern is also preferably changed into such a fill-in variation pattern suitable for the changed basic variation pattern. To this end, it is necessarily required to prepare a fill-in variation pattern having a part structure similar to that of the basic variation pattern. As a result, the setting operation that should be carried out before the musical play is performed would become complex, and cumbersome.

SUMMARY OF THE INVENTION

The present invention has be made to solve the above-explained problems, and therefore, has an object to provide an automatic accompanying apparatus and an automatic accompanying method, capable of executing an automatic accompaniment which is matched with a motif of a musical player through an entire music, and moreover, capable of simplifying a setting operation which should be carried out before executing the musical play.

In the automatic accompanying apparatus and the automatic accompanying method according to the present invention, the respective part structures of a plurality of basic variation patterns used as a basic accompanying pattern of rhythm are arbitrarily set by a music player. When the music player selects one basic variation pattern from a plurality of basic variation patterns to which the part structures are set in an above-described manner, the part structure is automatically set in such a manner that part structures of an intro-pattern, an ending pattern, and also a fill-in pattern, which are prepared for this rhythm, are made equal to the part structure of the selected basic variation pattern. The automatic accompaniment is carried out by employing the selected basic variation pattern, and the intro-pattern, ending pattern, and fill-in pattern, which own the same part structures as that of this basic variation pattern. As a result, the automatic accompaniment can be carried out while being matched with a motif of a user through the entire music. Moreover, the parameter setting operation executed before starting the musical play can be simplified.

Also, in accordance with the present invention, while the music player previously sets the respective part structures of the plural basic variations, this music player selects one basic variation pattern that is fitted to his motif while the automatic accompaniment is performed. As a consequence, since the part structures of the intro-pattern, the ending pattern, and the fill-in pattern are automatically set in such a manner that these part structures can become identical to the part structure of the selected basic variation pattern, the automatic accompaniment can be carried out which is matched with the motif of the musical player through the overall music. In addition, since the part structures of the intro-pattern, the ending pattern, and the fill-in pattern need not be set, the setting operation which is carried out before commencing the musical play can be made simply.

BRIEF DESCRIPTION OF THE DRAWINGS

For a better understanding of the present invention, reference is made of a detailed description to be read in conjunction with the accompanying drawings, in which:

FIG. 3 is an illustration of a memory allocation of a work memory 12 indicated in FIG. 1;

DESCRIPTION OF THE PREFERRED EMBODIMENTS

Figure 1:
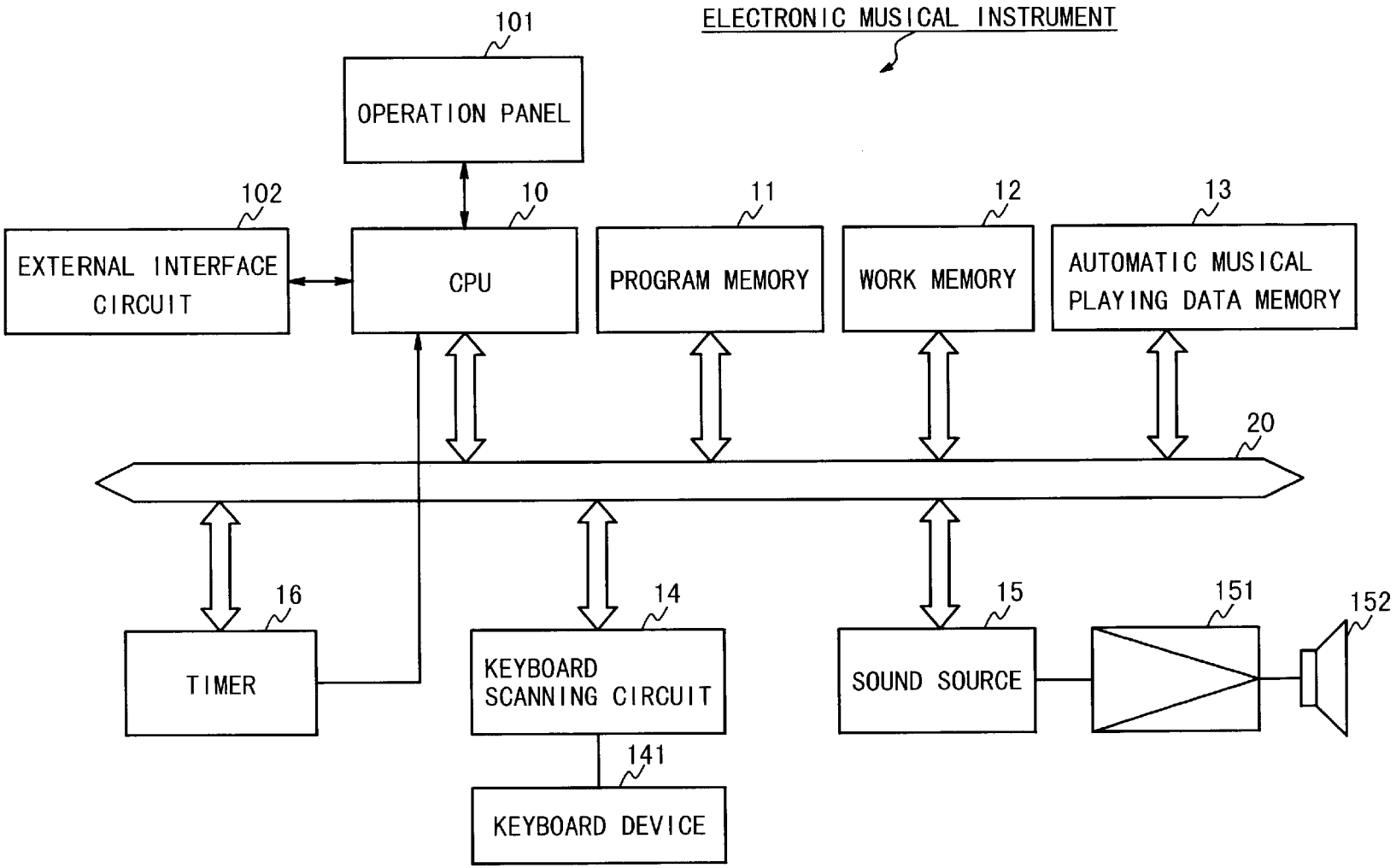
FIG. 1 is a schematic block diagram for representing an overall arrangement of an electronic musical instrument to which an automatic accompanying apparatus according to an embodiment of the present invention is applied.

Referring now to drawings, a description is made of an automatic accompanying apparatus and also an automatic accompanying method, according to a preferred embodiment of the present invention. It should be noted that although the following description is made of an automatic accompanying apparatus assembled in an electronic musical instrument, this automatic accompanying apparatus itself may be arranged as an independent apparatus.

OVERALL ARRANGEMENT OF ELECTRONIC MUSICAL INSTRUMENT EQUIPPED WITH AUTOMATIC ACCOMPANYING APPARATUS

Before describing an electronic music instrument equipped with an automatic accompanying apparatus according to an embodiment of the present invention, a major featured performance of this automatic accompanying apparatus will now be described.

It is now assumed that the automatic accompanying apparatus of this embodiment contains 100 sorts of accompanying patterns in order that the automatic accompaniments are available with 100 sorts of rhythm. Also, a basic pattern is arranged by 4 sets of basic variation patterns. These basic variation patterns will be referred to as a "basic 1 pattern", a "basic 2 pattern", a "basic 3 pattern", and a "basic 4 pattern", respectively. Similarly, a fill-in pattern is arranged by 4 sets of fill-in variation patterns. These fill-in variation patterns will be referred to as a "fill-in 1 pattern", a "fill-in 2 pattern", a "fill-in 3 pattern", and a "fill-in 4 pattern". Furthermore, the respective patterns of the "basic 1 to 4 patterns"; the "fill-in 1 to 4 patterns"; and an "intro-" pattern and an "ending" pattern are arranged by 5 parts such as a drum, a bass, ACC1, ACC2, and ACC3.

FIG. 1 is a schematic block diagram for representing an overall arrangement of an electronic musical instrument to which the above-explained automatic accompanying apparatus according to this embodiment of the present invention is applied. This electronic musical instrument is mainly arranged by a central processing unit (will be simply referred to as a "CPU" hereinafter) 10, a program memory 11, a work memory 12, an automatic musical playing data memory 13, a keyboard scanning circuit 14, a sound source 15, and a timer 16. These structural elements are mutually connected via a system bus 20. Furthermore, an operation panel 101 and an external interface circuit 102 are connected to the CPU 10. Also, an interrupt signal is supplied from the timer 16 to this CPU 10. A keyboard device 141 is connected to the keyboard scanning circuit 14. Furthermore, an amplifier 151 is connected to the sound source 15, and a speaker 152 is connected to this amplifier 151.

The CPU 10 controls the entire system of this electronic musical instrument in accordance with a control program stored in the program memory 11. The various process operations executed by this CPU 10 will be discussed in detail with reference to flow charts.

The program memory 11 is arranged by, for instance, a read-only memory (will be simply referred to as a "ROM" hereinafter). This program memory 11 stores thereinto various sorts of system-fixed data that may be used in the CPU 10 in addition to the above-explained control program. This program memory 11 further stores thereinto a plurality of tone (timbre) parameters used to designate desirable tones, or timbres. One tone parameter is used to designate a tone of a certain sound range of a musical instrument. Each of these tone parameters is constructed of a waveform address, frequency data, envelope data, a filter coefficient, and the like.

The work memory 12 is arranged by a random access memory (will be referred to as a "RAM" hereinafter). This work memory 12 temporarily stores thereinto various data processed by the CPU 10. A concrete memory content of this work memory 12 will be explained later. The automatic musical playing data memory 13 is constituted by a ROM, and is used to store thereinto automatic musical playing data. The automatic musical playing data is used to produce an automatic accompanying sound. A detailed content of this automatic musical playing data will be explained later in detail.

OPERATION PANEL

Figure 2:
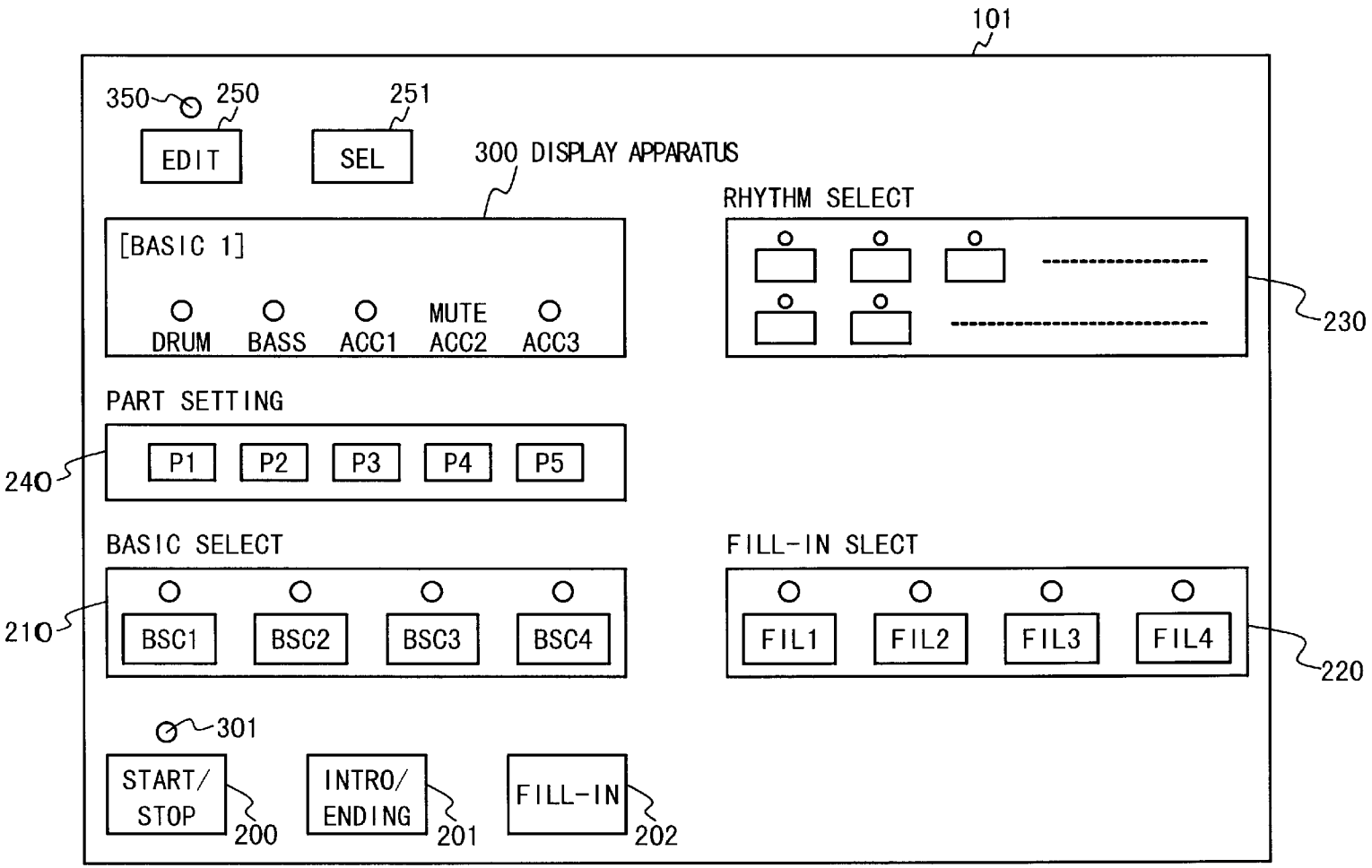
FIG. 2 illustratively shows a concrete example of an operation panel 101 provided in the electronic musical instrument of FIG. 1.

As illustratively shown in FIG. 2, the above-explained operation panel 101 is arranged by a start/stop switch 200, an intro/ending switch 201, a fill-in switch 202, a basic selection switch 210, a fill-in selection switch 220, a rhythm selection switch 230, a part setting switch 240, a edit switch (symbol "EDIT") 250, and furthermore, an edit selection switch (symbol "SEL") 251. These switches may be constituted by push button switches. It should be understood that although being omitted from this drawing, this operation panel 101 is equipped with a sound volume, a tone (timbre) selection switch, a reverberation effect selection switch and so on.

Also, this operation panel 101 is equipped with a display apparatus 300 for displaying thereon various messages, and also indicators 301, 350 etc. for displaying thereon an ON/OFF state of a switch. As this display apparatus 300, an LCD (liquid crystal display), a CRT (cathode-ray tube) display unit, a plasma display unit, and so on may be employed. Further, as the indicators 301 and 350, an LED (light emitting diode), a lamp, and the like may be utilized.

The start/stop switch 200 is used to instruct starting and/or stopping of an automatic accompaniment. This start/stop switch 200 is provided with the indicator 301. When the start/stop switch 200 is depressed while an automatic accompaniment is stopped, the indicator 301 is turned ON, and furthermore, the automatic accompaniment (basic musical play) is commenced. On the other hand, when the start/stop switch 200 is depressed while an automatic accompaniment is executed, the indicator 301 is turned OFF, and also the automatic accompaniment is stopped.

The intro/ending switch 201 is used to start any one of an intro-musical play (introduction playing) and an ending musical play. When the intro/ending switch 201 is depressed while an automatic accompaniment is stopped, the intro-musical play is commenced, and the basic musical play is commenced in such a case that this intro-musical play is completed. On the other hand, when the intro/ending switch 201 is depressed while a basic musical play is performed, such a basic music play under execution is stopped, and subsequently the ending musical play is carried out. Thereafter, the automatic accompaniment is stopped.

The fill-in switch 202 is used to insert a fill-in musical play into a basic musical play under execution. In other words, when this fill-in switch 202 is depressed while the basic musical play is executed, this basic musical play under execution is temporarily interrupted and several bars of the fill-in musical play are played. Thereafter, the original basic musical play is again started.

The basic selection switch 210 is constituted by 4 sets of switches BSC1 to BSC4 corresponding to the respect "basic 1 pattern" to "basic 4 pattern". Each of these switches BSC1 to BSC4 is equipped with an indicator. A user can select a basic variation pattern used in an automatic accompaniment by depressing any one of these switches BSC1 to BSC4. Also, since the indicator corresponding to the depressed switch is turned ON, the user can recognize such a basic variation pattern under selection.

The fill-in selection switch 220 is constituted by 4 sets of switched FIL1 to FIL4 corresponding to the respect "fill-in 1 pattern" to "fill-in 4 pattern". Each of these switches by 4FIL1 to FIL4 is equipped with an indicator. A user can select a fill-in variation pattern used in an automatic accompaniment by depressing any one of these switches FIL1 to FIL4. Also, since the indicator corresponding to the depressed switch is turned ON, the user can recognize such a fill-in variation pattern under selection.

The rhythm selection switch 230 is constituted by 100 sets of switches corresponding to 100 sorts of rhythm, respectively. Each of these 100 switches is equipped with an indicator. A user can select rhythm used in an automatic accompaniment by depressing any one of these switches. Also, since the indicator corresponding to the depressed switch is turned ON, the user can recognize such a rhythm under selection.

The part setting switch 240 is arranged by 5 sets of switches P1 to P5 corresponding to 5 parts, respectively. Each of these switches P1 to P5 is used as to whether or not each music part is muted. Music part names allocated to the respective switches P1 to P5 are displayed on the display apparatus 300. For example, when the switch P1 is depressed under such a condition that a symbol "O" is indicated at a drum part position (namely, such a position where "DRUM" is indicated) of the display apparatus 300, the indication is changed from the symbol "O" into an indication "MUTE". As a result, the drum part is muted. Under such a drum part muting condition, when the switch P1 is depressed, the indication "MUTE" is returned to the symbol "O", and the muting operation is released.

The edit switch 250 is used to enter the operation mode of this electronic musical instrument into an edit mode. This edit switch 250 is equipped with an indicator 350. In this edit mode, the part structures of the respective basic 1 pattern to basic 4 pattern may be set. In other words, when the edit switch 250 is depressed, the indicator 350 is turned ON, and also the display apparatus 300 displays such a part structure of a music part under selection. For instance, FIG. 2 represents the part structure of the basic 1 pattern. The user may change the part structure of the basic 1 pattern by manipulating the part setting switch 240 under this condition.

The edit selection switch 251 is used to select a basic variation pattern edited in the edit mode. Every time this edit selection switch 251 is depressed, the basic pattern to be edited is cyclically changed in such a manner, for instance, from "basic 1 pattern" via "basic 2 pattern", and "basic 3 pattern" to "basic 4 pattern".

This operation panel 101 is equipped with a panel interface circuit (not shown). In response to an instruction issued from the CPU 10, this panel interface circuit scans the respective switches provided on the operation panel. Then, the panel interface circuit produces panel data based upon a signal indicative of an open/close stage of each switch, which is acquired by this switch scanning operation. This panel data is arranged by a bit stream made by that the respective bits correspond to the respective switches. Each of these bits is set to "1" when a switch is turned ON, whereas each of these bits is set to "0" when this switch is turned OFF. This panel data is used so as to judge as to whether or not the respective switches provided on the operation panel 101 are depressed (will be explained more in detail).

Also, the panel interface circuit sends display data transferred from the CPU 10 to the display apparatus 300. As a result, a message corresponding to the display data is indicated on the display apparatus 300. Also, the panel interface circuit sends turn-ON/OFF control data supplied from the CPU 10 to the indicators 301, 350, and the like. As a result, the relevant indicator may be turned ON, or turned OFF.

Returning back to the above-explained overall arrangement of this electronic musical instrument, the external interface circuit 102 controls data transmitting/receiving operations executed between the CPU and an external appliance (not shown in detail). As this external interface circuit 102, general-purpose interfaces such as MIDI, RS232C, and SCSI, and furthermore, interfaces specific to sorts of appliances externally connected to this electronic musical instrument may be utilized, depending upon types of externally provided electronic appliances. As this external appliance, a personal computer, a sequencer, another electronic musical instrument, and the like may be employed. In this embodiment, a MIDI interface circuit is employed as the external interface circuit 102.

Furthermore, the timer 16 connected to the CPU 10 produces an interrupt signal in a time interval that is defined by data set from this CPU 10. To this timer 16, data produced in proportional to a tempo is set. This interrupt signal is supplied to the CPU 10 so as to be used as a trigger signal capable of initiating an interrupt process routine (will be discussed later).

The keyboard device 141 is used to instruct that a sound is produced and/or a sound is erased. This keyboard device 141 employs a 2-contact system. That is to say, each of keys provided in this keyboard device 141 is equipped with a first key switch and a second key switch. The first key switch and the second key switch are turned ON with having different depression depths. The signals indicative of ON/OFF states of the first and second key switches are supplied to the keyboard scanning circuit 14.

The keyboard scanning circuit 14 scans the first key switch and the second key switch in response to a command issued from the CPU 10. Then, the keyboard scanning circuit 14 produces keyboard data based on the signals indicative of the ON/OFF states of the first and second key switches obtained by scanning these key switches. The keyboard data is constructed of a bit stream formed by that the respective bits of this bit stream correspond to the respective keys. Each of these bits is set to "1" when a key is depressed, whereas each of these bits is set to "0" when a key is released. This keyboard scanning circuit 14 judges that the relevant key is depressed in such a case that both the first key switch and the second key switch are turned ON, whereas this keyboard scanning circuit 14 judges that the relevant key is released in any cases other than the above-explained key turn-ON case.

Also, this keyboard scanning circuit 14 measures a time duration defined after the first key switch is turned ON until the second key switch is turned ON by depressing the key, and then, produces velocity data based on this measured time duration. Above-described keyboard data and the velocity data are sent to the CPU 10 via the system bus 20.

The sound source 15 contains a waveform memory (not shown in detail). This waveform memory stores thereinto a plurality of waveform data corresponding to a plurality of tone (timbre) parameters, respectively. The respective waveform data are produced in such a manner that music sound signals produced in accordance with natural musical instrument sounds are modulated by the pulse code modulating (PCM) method. This waveform memory is constituted by a ROM.

Also, a plurality of channels is formed in this sound source 15. When a sound is produced, at least one channel is allocated to produce the sound, and a tone parameter is supplied to this allocated channel. The channel which receives the tone parameter sequentially reads out the waveform data from the waveform memory, and adds the envelope to the read waveform data, so that the music sound signal is produced. This music sound signal is amplified by the amplifier 151, and thereafter, the amplified music sound signal is supplied to the speaker 152. As a result, this supplied music sound signal 15 converted into an acoustic signal by the speaker 152.

MEMORY CONTENTS OF WORK MEMORY

Referring now to FIG. 3, a description will be made of registers, counters, flags, and the like, which are allocated to the above-explained work memory 12. It should be noted that other elements will be explained, if necessary.

(a) "automatic musical playing flag AUTO"—a flag for indicating as to whether or not an automatic musical play is performed. This automatic music playing flag AUTO is inverted every time the start/stop switch 200 provided on the operation panel 101 is depressed. This automatic musical playing flag AUTO of "1" indicates "under automatic accompaniment", and "0" indicates "automatic accompaniment is stopped".

(b) "edit flag EDIT"—a flag for indicating as to whether or not an operation mode is an edit mode. This edit flag EDIT is inverted every time the edit switch 250 provided on the operation panel 101 is depressed. This edit flag EDIT of "1" represents "edit mode", and "0" represents "normal mode".

(c) "edit part register"—a register for storing a musical part under edition.

(d) "rhythm number register"—a register for storing a rhythm number under selection.

(e) "basic number register"—a register for storing the number of a basic variation pattern under selection.

(f) "basic-1-part structure register"—a register for storing a part structure of the basic 1 pattern.

(g) "basic-2-part structure register"—a register for storing a part structure of the basic 2 pattern.

(h) "basic-3-part structure register"—a register for sorting a part structure of the basic 3 pattern.

(i) "basic-4-part structure register"—a register for storing a part structure of the basic 4 pattern.

(j) "fill-in number register"—a register for storing the number of a fill-in variation pattern under selection.

(k) "current part structure register"—a register for storing a part structure of an accompanying pattern used in the present automatic accompaniment.

(l) "clock counter"—a counter for counting a timer interrupt. This clock counter is incremented every time a timer interrupt is issued.

(m) "check timing counter"—a counter for measuring a time duration of 1 step time. This check timing counter is incremented by 1 every time a time duration corresponding to 1 step time has passed. The count content of this check timing counter is used to judge as to whether or not read timing is issued in an automatic musical playing process operation (will be discussed).

(n) "step time counter COUNT"—a counter for counting step time. This step time counter is counted up every one step time.

(o) "drum part address register"—a register for saving an address indicative of a storage position of musical note data of a drum part under play, within the automatic musical playing data memory 13.

(p) "bass part address register"—a register for saving an address indicative of a storage position of musical note data of a bass part under play, within the automatic musical playing data memory 13.

(q) "ACC1-part address register"—a register for saving an address indicative of a storage position of musical note data of an ACC1-part under play, within the automatic musical playing data memory 13.

(r) "ACC2-part address register"—a register for saving an address indicative of a storage position of musical note data of an ACC2-part under play, within the automatic musical playing data memory 13.

(s) "ACC3-part address register"—a register for saving an address indicative of a storage position of musical note data of an ACC3-part under play, within the automatic musical playing data memory 13.

(t) "current part pointer"—a pointer for pointing out an address register of a musical part under play in the automatic musical playing process.

AUTOMATIC MUSICAL PLAYING DATA

Next, the automatic musical playing data stored in the automatic musical playing data memory 13 will now be explained more in detail. It should also be noted that rhythm numbers "1" to "100" are given to 100 sorts of rhythm produced from this automatic accompanying apparatus.

Figure 4:
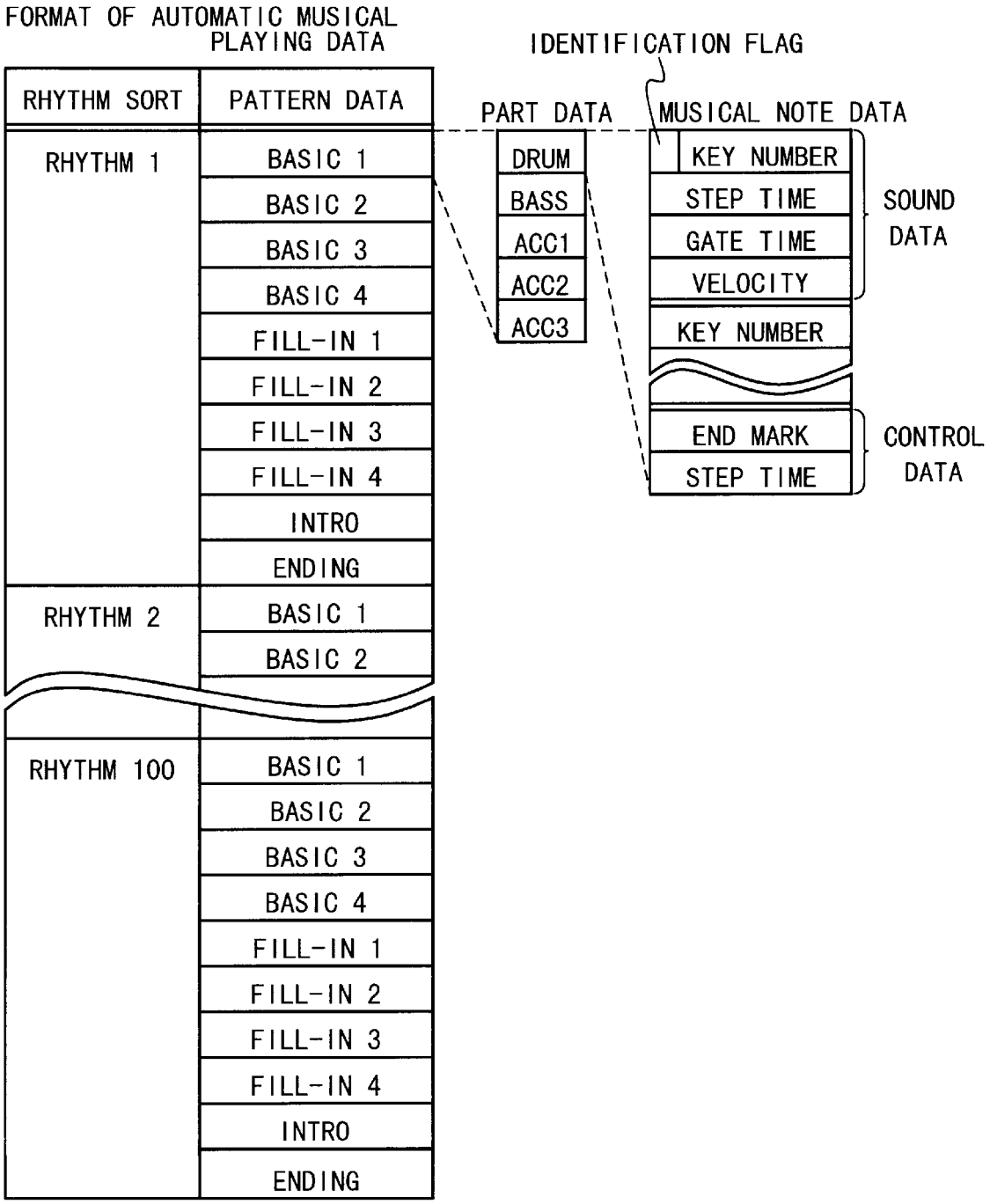
FIG. 4 is an explanatory diagram for explaining a format of automatic musical playing data stored in an automatic musical playing data memory 13 indicated in FIG. 1.

As shown in FIG. 4, the automatic musical playing data is stored into the automatic musical playing data memory 13, while being sectioned with respect to each of the 100 sorts of rhythm. The automatic musical playing data of each rhythm is constituted by 10 sorts of pattern data such as "basic 1 to 4 pattern data"; "fill-in 1 to 4 pattern data"; "intro-pattern data"; and "ending pattern data".

Each pattern data is arranged by 5 sets of part data such as drum part data, bass part data, ACC1-part data, ACC2-part data, and ACC3-part data. Furthermore, as indicated in FIG. 4, each part data is arranged by a plurality of musical note data. Musical note data contains sound data and control data.

A most significant bit (MSB) of a first byte (key number) of musical note data is an identification flag used to identify as to whether this musical note data corresponds to sound data, or control data. The identification flag of "1" indicates "sound data", and "0" indicates "control data".

The sound data is used to produce one sound. This sound data is arranged by such data for designating an identification flag, a key number, step time, gate time, and a velocity. The "key number" (lower 7 bits of first byte) corresponds to numbers given to the respective keys of the keyboard device 141. This key number is used to designate a musical interval. The "step time" is to designate start timing (time instant) of sound production. The "gate time" is employed to designate a length (sound length) of sound production. The "velocity" is used to designate strength of a sound. The respective part data are constituted in such a manner that the above-explained musical note data are arranged in the step time order.

The control data is used to control the automatic accompaniment such as a change of sound tone, a change of sound effect, and a change of tempo. A sort of this control is designated by the lower 7 bits of the first byte. Also, the control data contains end data. This end data is constituted by 2-byte data such as an end mark and step time. This end data is employed so as to designate an end of automatic musical playing data.

VARIOUS OPERATIONS OF AUTOMATIC ACCOMPANYING APPARATUS

Subsequently, various operations of the automatic accompanying apparatus with employment of the above-explained arrangement will now be described with reference to flow charts shown in FIG. 5 to FIG. 9. It should also be understood that process operations defined in the respective flow charts are carried out by the CPU 10.

(1) MAIN PROCESS OPERATION

Figure 5:
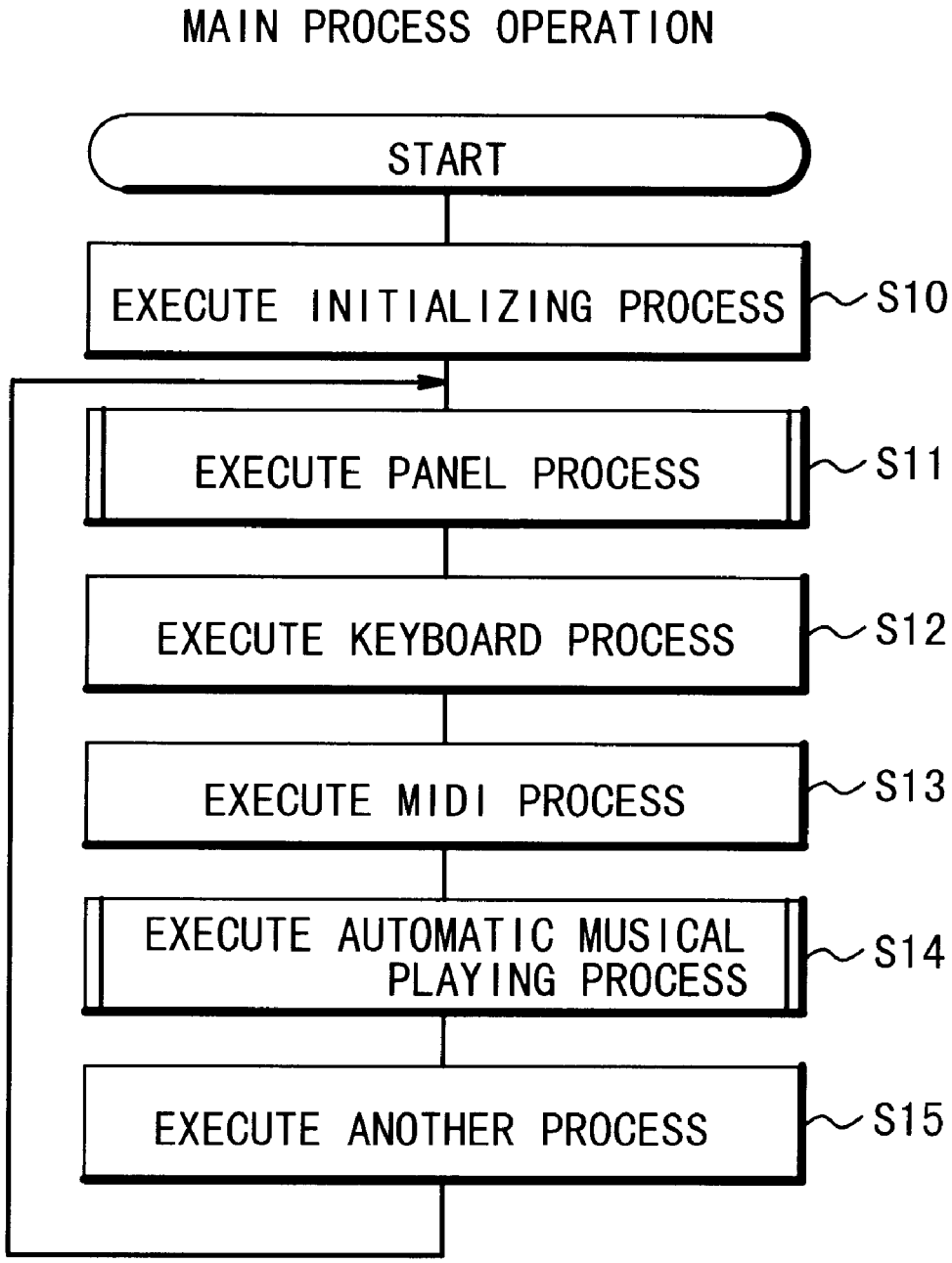
FIG. 5 is a flow chart for describing a main process operation of the electronic musical instrument to which the automatic accompanying apparatus according to the embodiment of the present invention is applied.
Figure 6:
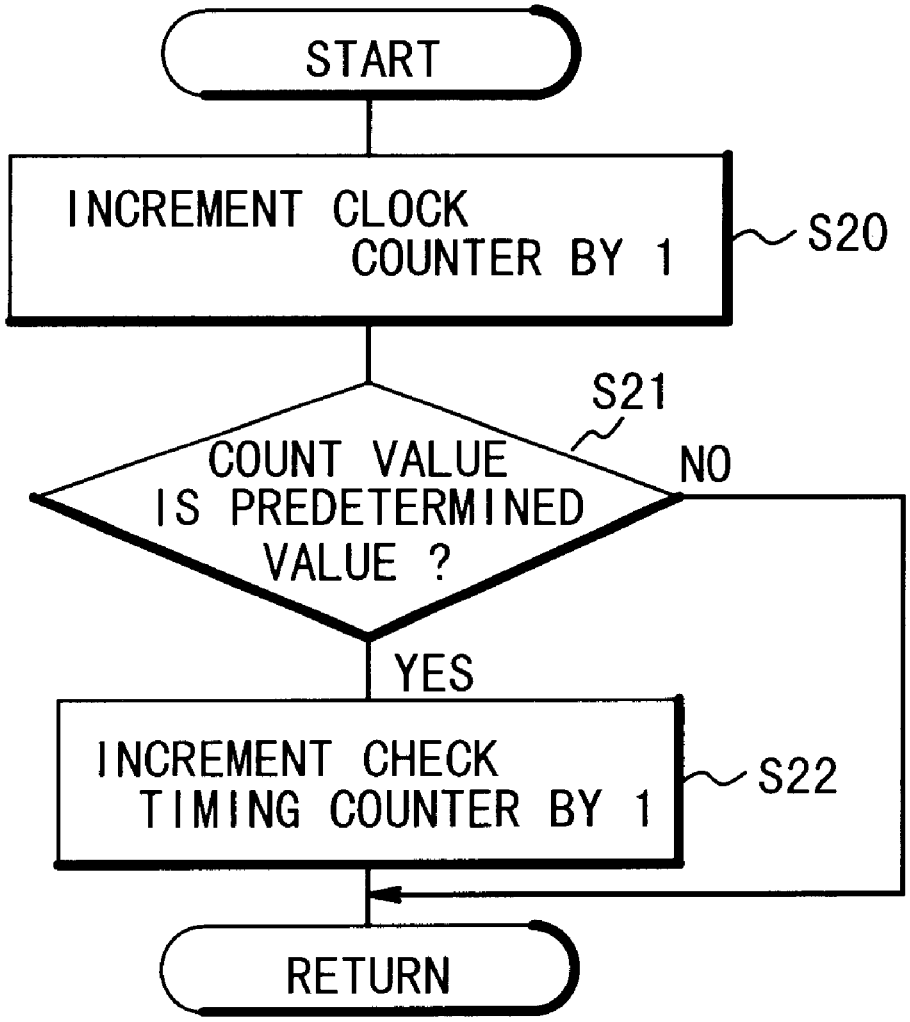
FIG. 6 is a flow chart for describing a timer interrupt process operation of the electronic musical instrument to which the automatic accompanying apparatus according to the embodiment of the present invention is applied.

FIG. 5 is a flow chart for describing a main process operation executed by the electronic musical instrument to which the automatic accompanying apparatus according to the embodiment of the present invention is applied. This main process routine is initiated by turning ON the power supply. First, when the power supply is turned ON, an initializing process operation is carried out at a step S10. In this initializing process operation, the hardware provided in the CPU 10 is set to the initial condition. Also, initial values are set to the registers, the counters, and also the flags defined in the above-explained work memory 12.

When this initializing process operation is ended, a panel process operation is subsequently carried out at a step S11. Although this panel process operation will be discussed more in detail, various process operations are carried out in order to realize the various functions allocated to the respective switches provided on the operation panel 101.

Next, keyboard process operation is executed at a step S12. In this keyboard process operation, both a sound producing process operation and a sound erasing process operation are carried out in response to key operation of the keyboard device 141. In other words, the CPU 10 first reads keyboard data and velocity data from the keyboard scanning circuit 14. Then, the CPU 10 checks as to whether or not the relevant key is depressed, or released based on the read keyboard data. In this case, when the CPU 10 judges that the relevant key is depressed, this CPU 10 executes such a sound producing operation capable of producing a sound having a strength, corresponding to this depressed key, in response to the velocity data.

In this sound producing process operation, one tone (timbre) parameter is read out from the program memory 11, and then is supplied to the sound source 15 in combination with the above-explained velocity data. This tone parameter is selected based upon both the depressed key and the tone (timbre) set at the time when this key is depressed. As a result, a music signal is produced from the sound source 15, and this music signal is supplied via the amplifier 151 to the speaker 152. Thus, such a sound corresponding to the depressed key is produced with having such a strength corresponding to the velocity data.

On the other hand, when the CPU 10 judges that the relevant key is released, this CPU 10 executes the sound erasing operation so as to erase such a sound corresponding to the released key. In this sound erasing process operation, preselected data is sent to the sound source 15. As a result, the music signal being produced from the sound source 15 is rapidly attenuated. As a result, the sound under production is erased in accordance with the released key.

Next, a MIDI process operation is carried out at a step S13. In this MIDI process operation, both a sound producing operation and a sound erasing operation are carried out based upon the data received by the external interface circuit 102, and furthermore, the setting commission of the operation panel 101 is changed. As a result, this electronic musical instrument may be controlled by the external apparatus. Conversely, the data that is produced by manipulating the operation panel 101 and the keyboard apparatus 141 is transmitted via this external interface circuit 102 to the external apparatus. As a consequence, the external apparatus may be controlled by the operation panel 101 and the keyboard apparatus 141 of this electronic musical instrument.

Next, an automatic musical playing process operation is carried out at a step S14. A detailed operation of this automatic musical playing process operation will be discussed later. Subsequently, "another process operation" is carried out at a step S15. This "another process operation" is any process operation other than the above-explained process operations, and involves such a process operation that is regularly checked in the main process routine. For example, this "another process operation" contains a process operation capable of realizing a specific operation in the case that a switch is continuously depressed.

Thereafter, the main process operation is returned to the previous step S11, and then, the process operations defined at the steps S11 to S15 are repeatedly performed. While these process operations are repeatedly carried out, when the operation panel 101 is manipulated, the keyboard device 141 is manipulated, and the MIDI data is received by the external interface circuit 102, the process operations corresponding to these operations are carried out. As a consequence, the various sorts of functions as the electronic musical instrument and the automatic accompanying apparatus can be realized.

(2) TIMER INTERRUPT PROCESS OPERATION

A timer interrupt process operation is executed in response to an interrupt signal issued from the timer 16 while interrupting the respective process operations of the above-described main process routine. A detailed operation of this timer interrupt process operation is described in a flow chart of FIG. 6.

In this timer interrupt process operation, the content of the clock counter is first incremented by 1 at a step S20. Since the interrupt signal is issued in a time interval defined in direct proportion to the tempo, the content of this clock counter is incremented by 1 in such a time interval defined in direct proportion to the tempo. Next, the CPU checks as to whether or not the content of this clock counter becomes a predetermined value at a step S21. In this embodiment, this predetermined value implies a value equivalent to 1 step time in such a tempo set at this time instant.

At this step S21, when the CPU 10 judges that the content of the clock counter becomes the predetermined value, the content of the check timing counter is incremented by 1 (step S22). Thereafter, the sequence operation is returned from this timer interrupt process routine. As a result, the main process operation is restarted from such a routine position where the main process routine is interrupted. To the contrary, when the CPU 10 judges that the content of the clock counter is not equal to the predetermined value, the sequence operation is returned from this timer interrupt process routine without changing the content of the check timing counter. The content of this check timing counter is incremented by 1 every time 1 step time has passed by executing the above-explained process operations.

(3) PANEL PROCESS OPERATION

Figure 7A:
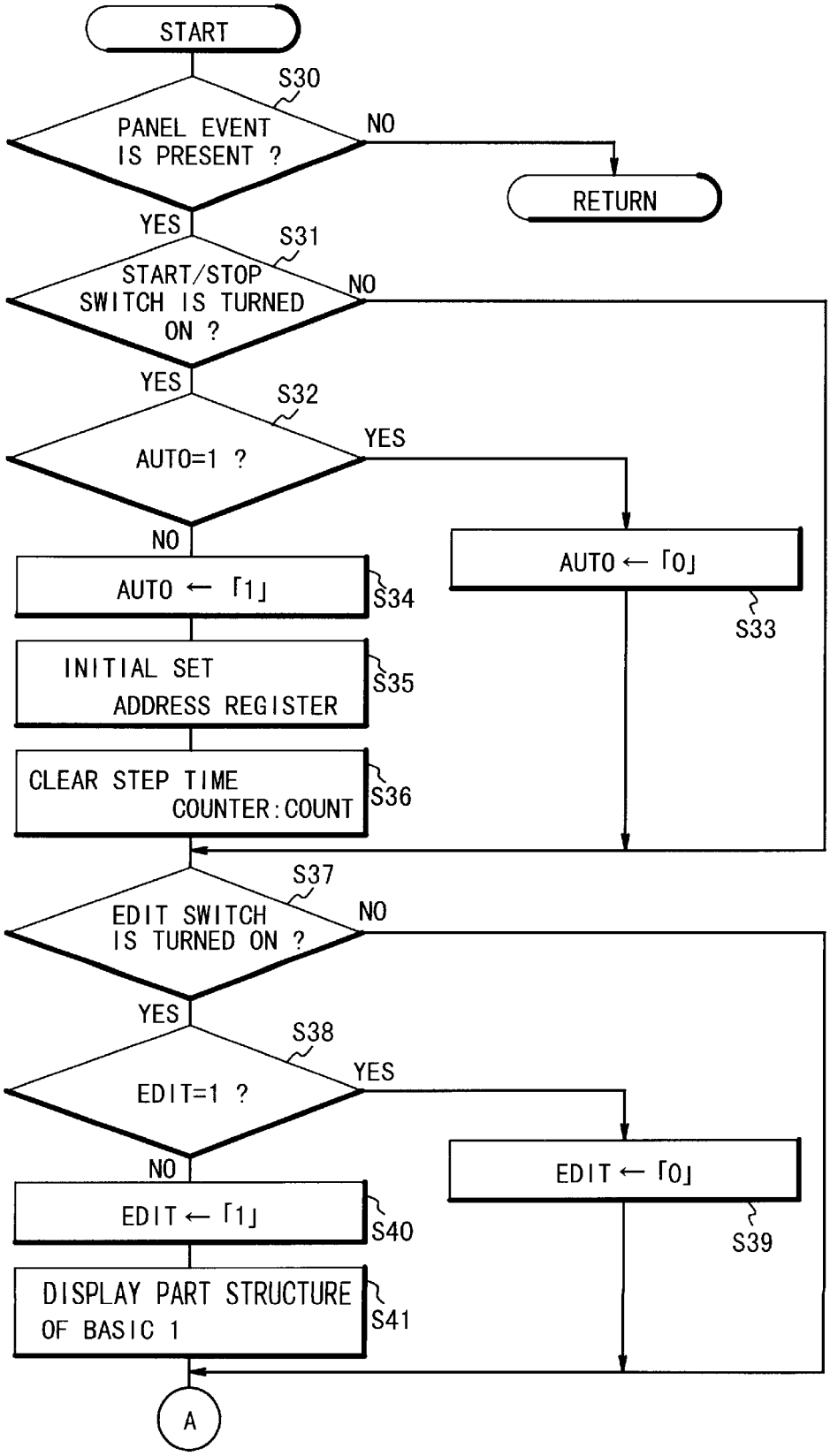
FIG. 7A to FIG. 7C are flow charts for explaining a detailed operation of the panel process executed in FIG. 5.
Figure 7B:
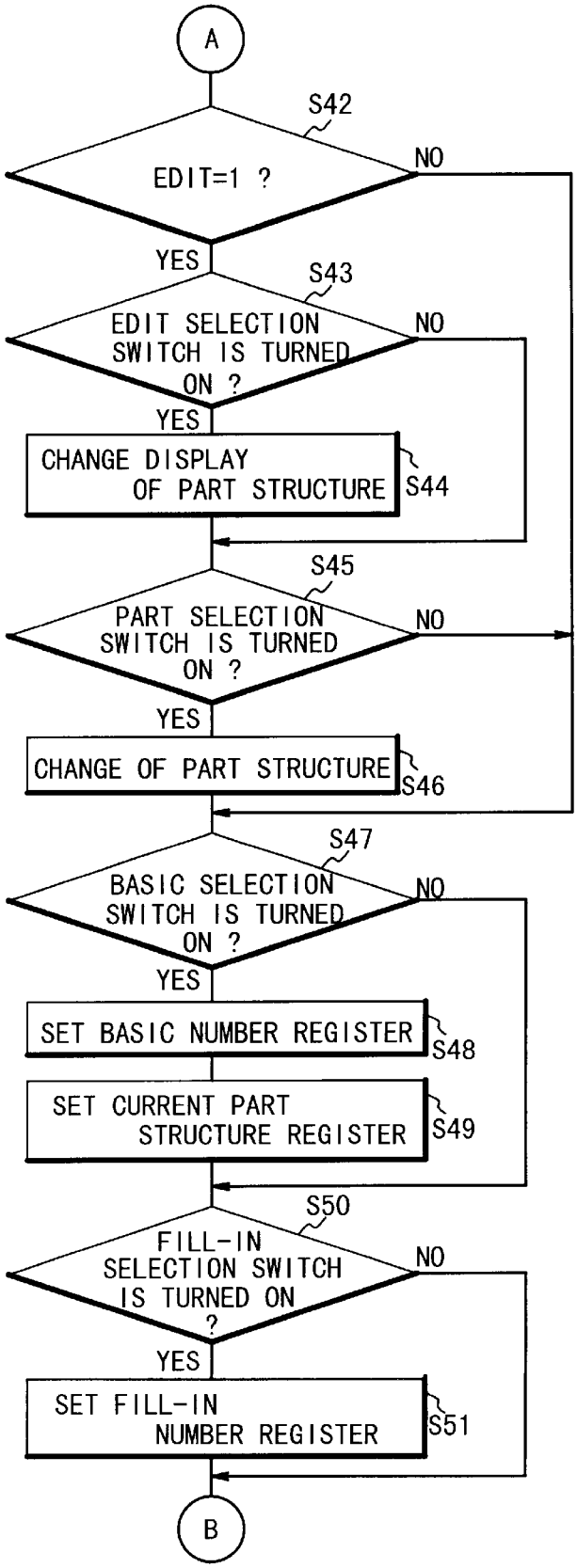
Figure 7C:
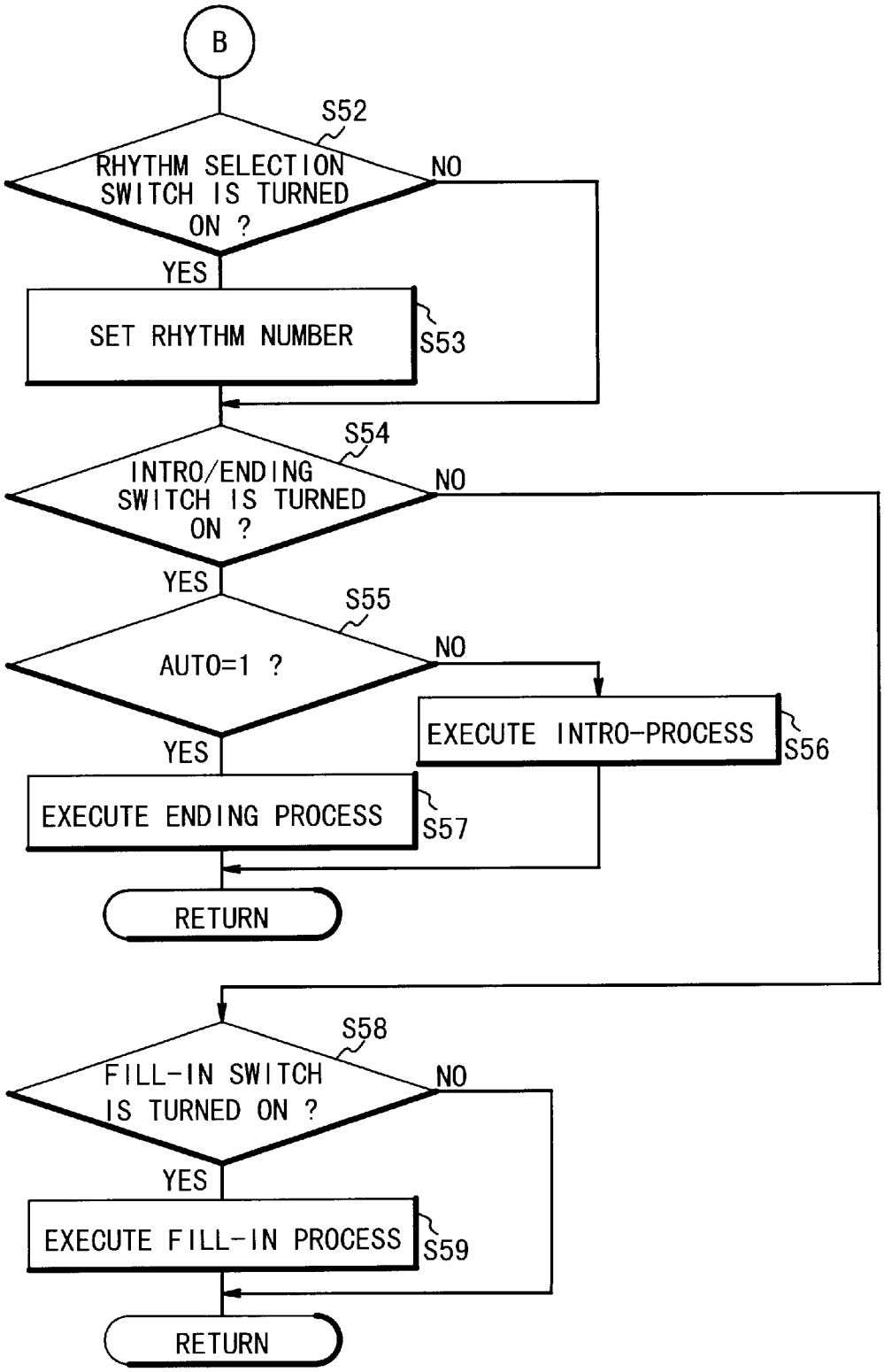

Referring to flow charts shown in FIG. 7A to FIG. 7C, a detailed operation of the above-explained panel process operation executed at the step S11 of the main process routine will be described. In this panel process operation, process operations for realizing the various functions are carried, and these functions are allocated to the respective switches provided on the operation panel 101.

In this panel process operation, the CPU 10 first checks as to whether or not a panel event is present at a step S30. That is, panel data is read out from the operation panel 101. Then, the CPU 10 further checks as to whether or not this presently read panel data is changed from such panel data which has been read during the previous panel process operation. When the presently read panel data is not changed from the previously read panel data, the CPU 10 recognizes that there is no panel event. Thus, the sequence operation is returned from this panel process routine to the main process routine.

On the other hand, when the CPU 10 judges at the step S30 that there is the panel event, namely the presently read panel data is changed, the CPU 10 subsequently checks as to whether or not the ON event of the start/stop switch 200 is present at a step S31. The existence or non-existence of the ON event of the start/stop switch 200 is checked by examining whether or not the bit corresponding to start/stop switch 200 in the panel data, which is equal to "0" in the previous panel process operation, and is changed into "1" in the current panel process operation. The existence or non-existence of the ON event of the other switch, to be described below, is examined by the method similar to the above.

When the CPU 10 judges at this step S31 that the ON event of the start/stop switch 200 is present, this CPU 10 checks as to whether or not the automatic musical playing flag AUTO is equal to "1" at a step S32. When the automatic musical playing flag AUTO is equal to "1", the CPU 10 judges that the start/stop switch 200 is depressed during the automatic accompaniment, and this automatic musical playing flag AUTO is cleared to "0" at a step S33. As a result, the sound producing operation is not carried out in an automatic musical playing process routine (will be discussed later). Therefore, in the case that the start/stop switch 200 is depressed during the automatic accompaniment, the function capable of stopping the automatic accompaniment is realized. Thereafter, the sequence operation is branched to a further step S37.

On the other hand, when the automatic musical playing flag AUTO is equal to "0" at the above-described step S32, the CPU 10 judges that the start/stop switch 200 is depressed while the automatic accompaniment is stopped, and this automatic musical playing flag AUTO is set to "1" at a step S34. As a result, in the case that the start/stop switch 200 is depressed while the automatic accompaniment is stopped, the function capable of starting the automatic accompaniment is realized. Since the process operations defined at the step S32 to the step S34 are executed, starting of the automatic accompaniment and stopping of the automatic accompaniment are alternately repeated every time the start/stop switch 200 is depressed.

Next, the initial setting operation of the address register is carried out at a step S35. In this process operation, a selection is made of such pattern data which is equal to the pattern data belonging to the rhythm selected at this time, and which corresponds to the basic variation pattern selected at this time. It should also be noted that the rhythm under selection is designated by the content of the rhythm number register. Also, the basic variation pattern under selection is designated by the content of the rhythm number. Then, head addresses of the respective part data contained in the selected pattern data are stored into the respective address registers. In other words, the head address of the part data of the drum part is stored into the drum part address register; the head address of the part data of the bass part is stored into the bass part address register; the head address of the part data of the ACC1 part is stored into the ACC1 part address register; and head address of the part data of the ACC2 part is stored into the ACC2 part address register; and further, the head address of the part data of the ACC3 part is stored into the ACC3 part address register. As a result, the preparation for reading the musical note data of the respective parts of the basic variation pattern is completed. Subsequently, in an automatic musical playing process routine (will be discussed later), the automatic accompaniment is advanced while sequentially updating the contents of the respective address registers.

Next, the content of the step time counter COUNT is cleared to "0" (step S36). Subsequently, the content of this step time counter COUNT is incremented by 1 every time read timing (will be explained more in detail) reaches in the automatic musical playing process routine. Conversely, when the CPU 10 judges that the ON event of the start/stop switch 200 is not present at the above step S31, the sequence operation is branched to a further step S37.

Next, the CPU 10 checks as to whether or not the ON event of the edit switch 250 is present at a step S37. When the CPU 10 judges that the ON event of this edit switch 250 is present, another check is made as to whether or not the edit flag EDIT is set to "1" at a step S38. Then, when the edit flag EDIT is "1", the CPU 10 recognizes such a fact that the edit switch 250 is depressed in the edit mode, and this edit flag EDIT is cleared to "0" at a step S39. As a result, the operation mode of this electronic musical instrument is advanced to the normal mode. Thereafter, the sequence operation is branched to a further step S42.

On the hand, when the edit flag EDIT is "0" at the step S37, the CPU 10 recognizes such a fact that the edit switch 250 is depressed in the normal mode, and this edit flag EDIT is set to "1" at a step S40. As a result, the operation mode of this electronic musical instrument is advanced to the edit mode. In this edit mode, a part structure of a desirable basic variation pattern may be changed by manipulating both the part setting switch 240 and the edit selection switch 251.

Subsequently, the part structure of the basic 1 is displayed on the display apparatus 300 at a step S41. That is, as shown in FIG. 2, the muting conditions of the respective music parts are displayed on the display apparatus 300 based on the content of the basic-1-part structure resister. As a result, the user may change the part structure of the basic 1 by manipulating the part setting switch 240 while observing the display apparatus 300. Since the process operations defined from the step S38 to the step S40 are carried out, the edit mode and the normal mode are alternately set every time the edit switch 250 is depressed. When the CPU 10 judges that the ON event of the edit switch 250 is not present at the above step S37, the sequence operation is advanced to a step S42.

At this step S42, the CPU 10 checks as to whether or not the edit flag EDIT is "1". Now when this edit flag EDIT is set to "1", the CPU 10 recognizes that the present operation mode is equal to the edit mode. Next, the CPU 10 further checks as to whether or not the ON event of the edit selection switch 251 is present at a step S43. At this stage, when the CPU 10 judges that the ON event of the edit selection switch 251 is present, the display content of the display apparatus 300 is changed into the part structure of the next basic variation pattern at a step S44. As a consequence, the basic variation pattern that should be edited is changed in the cyclic manner from the basic 1 via the basic 2, the basic 3, and the basic 4 to the basic 1 every time the edit selection switch 251 is depressed in the edit mode.

When the CPU 10 judges that the ON event of the edit selection switch 251 is not present at the step S43, the process operation defined at the step S44 is skipped. Next, the CPU 10 checks as to whether or not the ON event of the part setting switch 240 is present at a step S45. In other words, the CPU 10 checks as to whether or not any one of the switches P1 to P5 is depressed. At this stage, when the CPU 10 judges that the ON event of the part setting switch 240 is present, the part structure is changed at a step S46. In other words, the storage content of the part structure register corresponding to the music part selected at this stage is changed in accordance with any one of the depressed switches P1 to P5. When the CPU 10 judges that the ON event of the part setting switch 240 is not present at the above-described step S45, the process operation defined at this step S46 is skipped. As a result, it is possible to realize such a function capable of changing the part structure of the basic variation pattern selected by the edit selection switch 251 in the edit mode.

When the CPU 10 judges that the edit flag EDIT is equal to "0" at the above step S42, the sequence operation is branched to a step S47. As a consequence, in such a case that both the edit selection switch 251 and the part setting switch 240 are manipulated in the normal mode, these switch operations are neglected.

Next, the CPU 10 checks as to whether or not the ON event of the basic selection switch 210 is present at a step S47. In other words, the CPU 10 checks as to whether or not any one of the switches BSC1 to BSC4 is depressed. At this stage, when the CPU 10 judges that the ON event of the basic selection switch 210 is present, the number of the basic variation pattern corresponding to the depressed switch is set to the basic number register at a step S48. The basic musical play is carried out in accordance with the basic variation pattern designated by the content of this basic number register.

Subsequently, the content of the part structural register is set to the current part structure register at a step S49, and this part structure register stores the part structure of the basic variation pattern designated by the content of the basic number register. In the below-mentioned automatic musical playing process routine, the sounds of the respective musical parts are produced based upon the content of this current part structure register. The part structure of this basic variation pattern may be applied to the intro-pattern, the ending pattern, and the fill-in pattern, respectively. As a result, the part structures of the respective intro-pattern, ending pattern, and fill-in pattern need not be previously set. When the CPU judges that the ON event of the basic selection switch 210 is not present at the above-described step S47, the sequence operation is branched to a further step S50.

Next, the CPU 10 checks as to whether or not the ON event of the fill-in selection switch 220 is present at a step S50. In other words, the CPU 10 checks as to whether or not any one of the switches FIL1 to FIL4 is depressed. At this stage, when the CPU 10 judges that the ON event of the fill-in selection switch 220 is present, the number of the fill-in variation pattern corresponding to the depressed switch is set to the fill-in number register at a step S51. The fill-in musical play is carried out in accordance with the fill-in variation pattern designated by the content of this fill-in number register. When the CPU 10 judges that the ON event of the fill-in selection switch 220 is not present at the above-described step S50, the process operation defined at this step S51 is skipped.

Next, the CPU 10 checks as to whether or not the ON event of the rhythm selection switch 230 is present at a step S52. In other words, the CPU 10 checks as to whether or not any one of the rhythm selection switches 230 is depressed. At this stage, when the CPU 10 judges that the ON event of the rhythm selection switch 230 is present, the number of the rhythm corresponding to the depressed switch is set to the rhythm number register at a step S53. The pattern data corresponding to the content of this rhythm number register is used in the automatic accompaniment. When the CPU 10 judges that the ON event of the rhythm selection switch 230 is not present at the above-step S52, the process operation defined at this step S53 is skipped.

Subsequently, the CPU 10 checks as to whether or not the ON event of the intro/ending switch 201 is present at a step S54. At this stage, when the CPU 10 judges that the ON event of this intro/ending switch 201 is present, a further check is made as to whether or not the automatic musical playing flag AUTO is equal to "1" at a step S55. Then, when the automatic musical playing flag AUTO is equal to "0", the CPU 10 recognizes that the automatic accompaniment is stopped, and therefore, the intro-process operation is carried out at a step S56.

In this intro-process operation, both the initial setting process for the address register and the clearing process for the step time counter COUNT are carried out. This initial setting process for the address register is identical to the above-described process defined at the step S35 except that the intro-pattern data is selected instead of the pattern data of the basic variation. Also, the clear process operation of the step time counter COUNT is identical to the above-described process operation defined at the step S36. As a result, the addresses used to read the musical note data of the respective musical parts of the intro-pattern are determined. Subsequently, in the below-mentioned automatic musical playing process routine, the intro-musical play is carried out while this determined address is updated.

On the other hand, when the automatic musical plying flag AUTO is equal to "1" at the above-step S55, the CPU 10 recognizes that the automatic accompaniment is being carried out, and then the ending process operation is carried out at a step S57. In this ending process operation, both the initial setting process for the address register and the clearing process for the step time counter COUNT are carried out. This initial setting process for the address register is identical to the above-described process defined at the step S35 except that the ending pattern data is selected instead of the pattern data of the basic variation. Also, the clear process operation of the step time counter COUNT is identical to the above-described process operation defined at the step S36. As a result, the addresses used to read the musical note data of the respective musical parts of the ending patterns are determined. Subsequently, in the below-mentioned automatic musical playing process routine, the ending-musical play is carried out while this determined address is updated.

To the contrary, when the CPU 10 judges that the ON event of the intro/ending switch 201 is not present, a further check is made as to whether or not the ON event of the fill-in switch 202 is present at a step S58. At this stage, when the CPU 10 judges that the ON event of the fill-in switch 202 is present, the fill-in process operation is carried out at a step S59.

In this fill-in process operation, both the initial setting process for the address register and the clearing process for the step time counter are carried out. This initial setting process for the address register is identical to the above-described process defined at the step S35 except that the pattern data of the fill-in variation is selected instead of the pattern data of the basic variation. Also, the clear process operation of the step time counter COUNT is identical to the above-described process operation defined at the step S36. As a result, the addresses used to read the musical note data of the respective musical parts of the fill-in variation pattern are determined. Subsequently, in the below-mentioned automatic musical playing process routine, the fill-in musical play is carried out while this determined address is updated. Thereafter, the sequence operation is returned to the main process routine. Similarly, when the CPU 10 judges that the ON event of the fill-in switch 202 is not present at the above-described step S58, the sequence operation is returned to the main process routine.

(4) AUTOMATIC MUSICAL PLAYING PROCESS

Figure 8A:
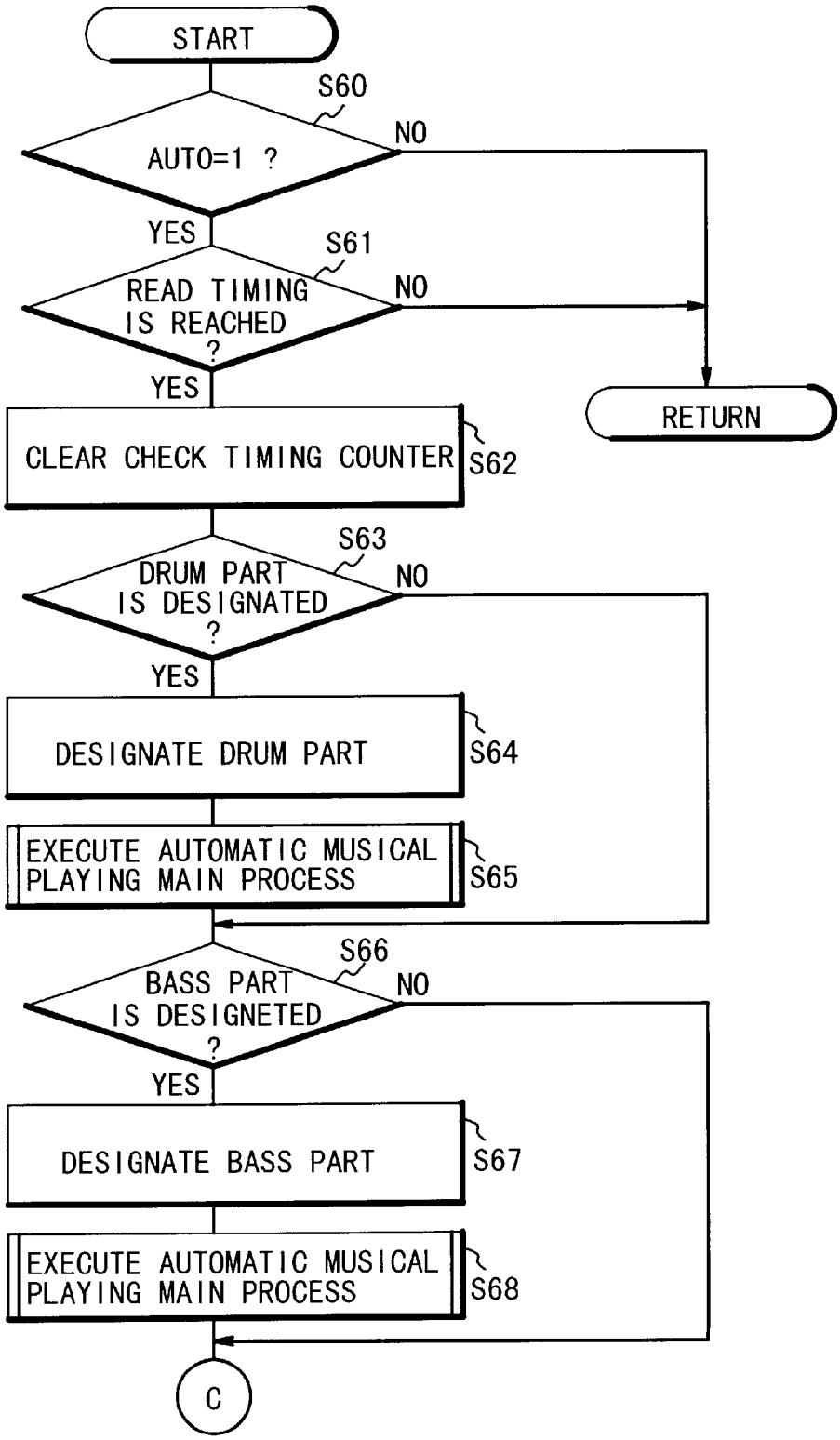
FIG. 8A and FIG. 8B are flow charts for describing a detailed operation of the automatic musical playing process executed in FIG. 5.
Figure 8B:
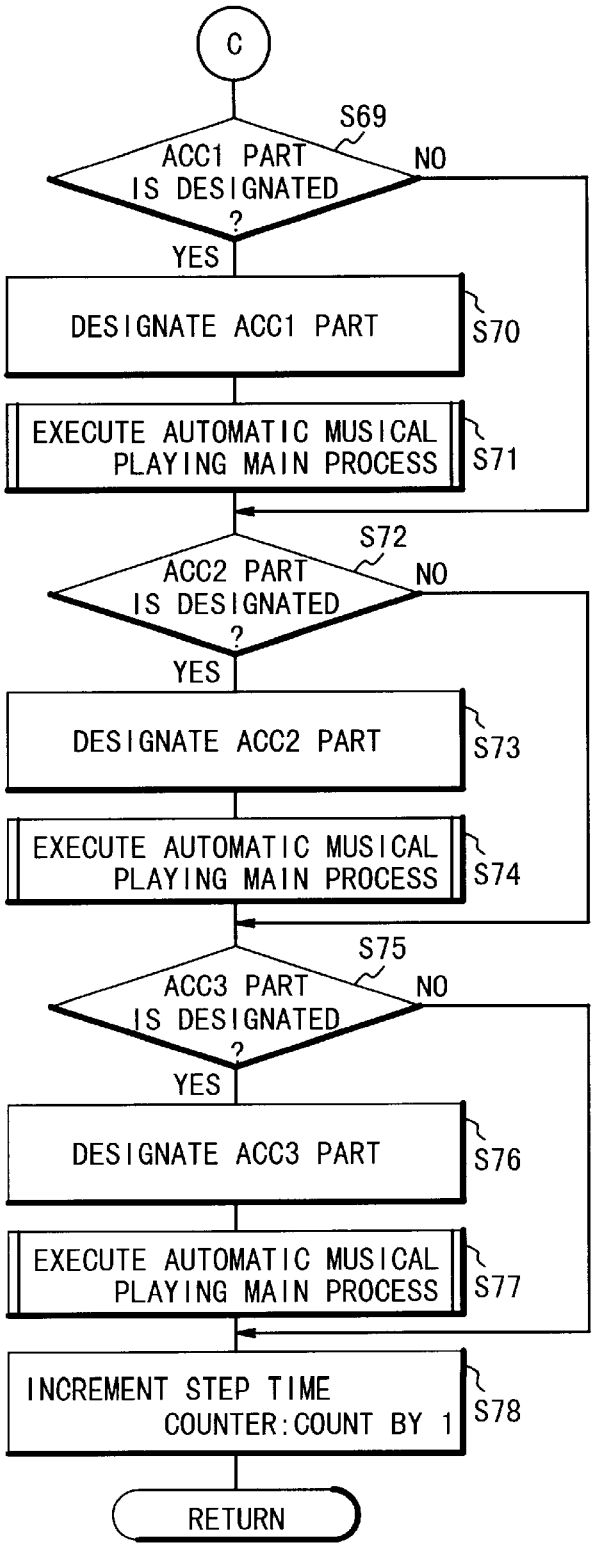

Referring now to flow charts indicated in FIG. 8A and FIG. 8B, the automatic musical plying process operation will be explained in detail. It should be understood that this automatic musical playing process routine is called from the main process routine in a preselected time period.

First, in this automatic musical playing process operation, the CPU 10 checks as to whether or not the automatic musical playing flag AUTO is equal to "1" at a step S60. At this stage, when this automatic musical playing flag AUTO is not equal to "1", namely when the CPU judges that the automatic accompaniment is stopped, the sequence operation is returned from this automatic musical playing process routine to the main process routine. As a result, it is possible to realize a function capable of stopping the automatic accompaniment.

On the other hand, when the automatic musical playing flag AUTO is equal to "1", namely when the CPU 10 judges that the automatic accompaniment is being carried out, the CPU 10 checks as to whether or not read timing is reached at a step S61. In this case, this read timing implies a time duration defined from a time instant when the previous automatic musical playing process operation was executed, until 1 step time has passed. The fact as to whether this read timing is reached may be recognized by checking as to whether or not, for instance, the content of the check timing counter becomes "1". At this step S61, when the CPU judges that the read timing is not yet reached, the sequence operation is returned from this automatic musical playing process routine to the main process routine.

On the other hand, when the CPU 10 judges that the read timing is reached at the step S61, the content of the check timing counter is cleared at a step S62. As a result, since the check timing counter is again set to "1" when the 1 step time has passed from the present time instant, this read timing is reached every 1 step time.

Next, another check is made as to whether or not the drum part is designated at a step S63. In other words, the CPU 10 checks as to whether or not the bit indicative of the drum part of the current part structure register is set to "1". Similarly, it is also possible to check as to whether or not other musical parts are designated. At this case, when the CPU 10 judges that the drum part is designated, the drum part address register is designated by the current part pointer (step S64). Next, the automatic musical playing main process is carried out at a step S65. Although this automatic musical playing main process will be discussed more in detail later, the sound producing process operation is carried out based on the musical note data. In such a case that the CPU 10 judges that the drum part is not designated at the above-described step S63, the sequence operation is branched to a further step S66. With employment of the above-described process operations, when the drum part is designated by the current part structure register, it is possible to realize such a function capable of producing the sound of the drum part.

Subsequently, a process operation similar to the above process operation is repeatedly carried out as to each of the musical parts. In other words, the CPU checks as to whether or not the bass part is designated at a step S66. When the bass part is designated, the bass part address register is designated by the current part pointer at a step S67. Next, the automatic musical playing main process operation is carried out at a step S68. On the other hand, when the bass part is not designated, the process operations defined at the step S67 and the step S68 are skipped. Next, the CPU 10 checks as to whether or not the ACC1 part is designated at a step S69. When the ACC1 part is designated, the ACC1 part address register is designated by the current part pointer at a step S70. Next, the automatic musical playing main process operation is carried out at a step S71. On the other hand, when the ACC1 part is not designated, the process operations defined at the step S70 and the step S71 are skipped.

Next, the CPU checks as to whether or not the ACC2 part is designated at a step S72. When the ACC2 part is designated, the ACC2 part address register is designated by the current part pointer at a step S73. Next, the automatic musical playing main process operation is carried out at a step S74. On the other hand, when the ACC2 part is not designated, the process operations defined at the step S73 and the step S74 are skipped. Next, the CPU 10 checks as to whether or not the ACC3 part is designated at a step S75. When the ACC3 part is designated, the ACC3 part address register is designated by the current part pointer at a step S76. Next, the automatic musical playing main process operation is carried out at a step S77. On the other hand, when the ACC3 part is not designated, the process operations defined at the step S76 and the step S77 are skipped. While the above described process operations are carried out, only the sound of such a musical part designated by the current part structure register is produced.

Subsequently, the content of the step time counter COUNT is incremented by 1 at a step S78. As a consequence, the content of the step time counter is incremented every time 1 step time has passed.

(5) AUTOMATIC MUSICAL PLAYING MAIN PROCESS

Figure 9:
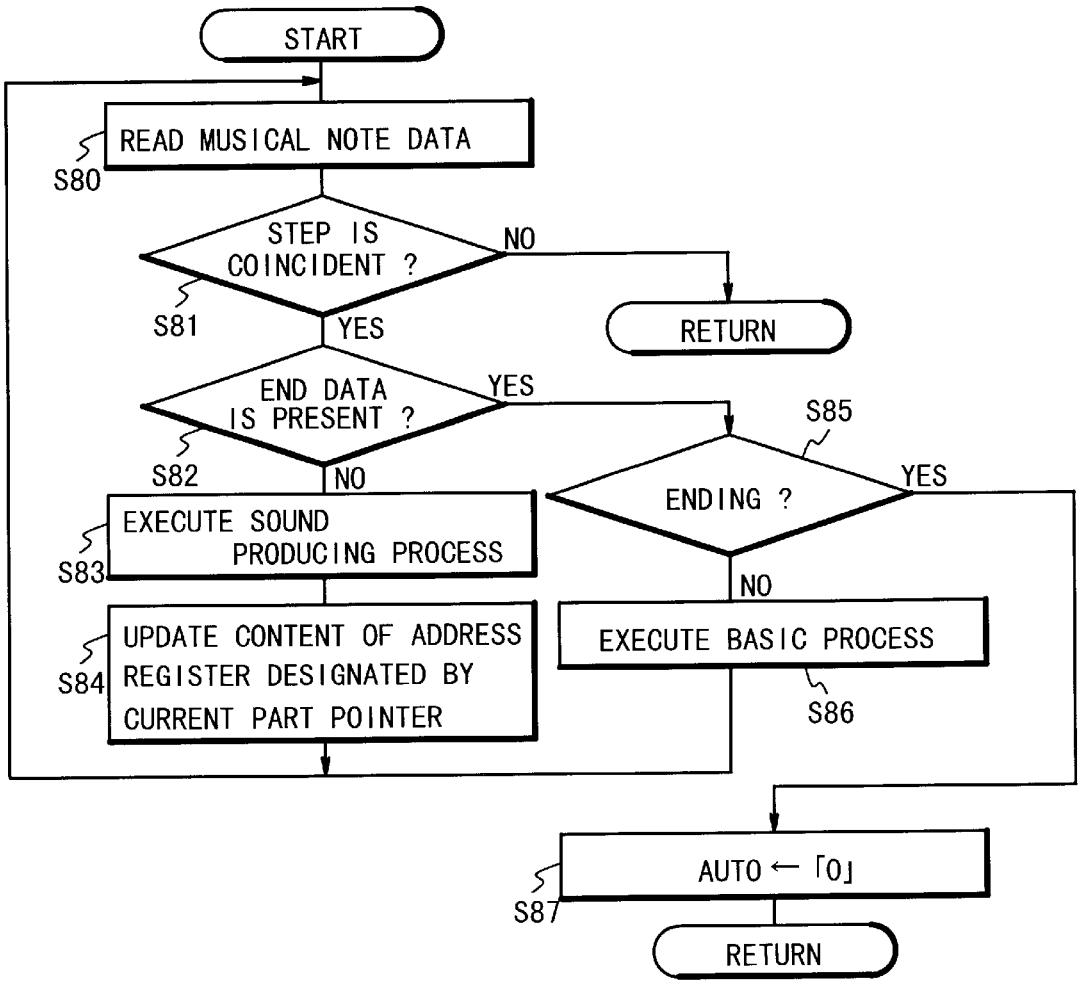
FIG. 9 is a flow chart for explaining a detailed operation of the automatic musical playing main process executed in FIG. 8A and FIG. 8B.

Next, the automatic musical playing main process executed in the above-described automatic musical playing process routine will now be explained more in detail with reference to a flow chart shown in FIG. 9.

In this automatic musical playing main process operation, first of all, one piece of musical note data is read from a position of the automatic musical playing data memory 13, which is designated by a content of the address register designated by the current part pointer at a step S80. Then, the CPU 10 checks as to whether or not step time contained in the read musical note data is made coincident with the content of the step time counter COUNT at a step S81. At this stage, when the CPU 10 judges that this step time is not made coincident with the content of this step time counter COUNT, this CPU 10 further judges that this musical note data is not yet reached to the sound producing timing. Then, the sequence operation is returned from this automatic musical playing main process routine to the automatic musical playing process routine.

On the other hand, when the CPU 10 judges that this step time is made coincident with the content of this step time counter COUNT, another check is made as to whether or not the musical note data read at the step S80 corresponds to the end data at a step S82. This check may be realized by investigating first byte data of this musical note data. At this stage, when the CPU 10 judges that the musical note data is not equal to the end data, the sound producing process operation is subsequently carried out at a step S83.

In this sound producing process operation, the sound production is allocated to one channel within the sound source 15. Then, a selection is made of one timbre parameter stored in the program memory 11 based upon the key number and the velocity contained in the musical note data, and the timbre selected at this time. The selected timbre parameter is sent to the sound source 15. As a consequence, in such a channel to which the sound production is allocated, a music signal is produced based on the selected timbre parameter. Then, this produced music signal is supplied via the amplifier 151 to the speaker 152. As a result, sounds are produced from the speaker 152.

It should also be noted that such a channel whose gate time becomes zero within the sound source 15 is retrieved, and preselected data is sent to the retrieved channel so as to erase the sound in a sound erasing process routine (not shown).

Next, the content of the address register designated by the current part pointer is updated at a step S84. In other words, the content of the drum part address register, the content of the bass part address register, the content of the ACC1-part address register, the content of the ACC2-part address register, or the content of the ACC3-part address register is incremented by 4. Thereafter, the sequence operation is returned to the previous step S80. At this step S80, the process operation is repeated in a similar manner to the above-described manner. While the above-described process operations are repeatedly performed, all of the musical note data having the same step time as the content of the step time counter COUNT are used to produce the sounds. As a result, a plurality of sounds can be produced at the same time.

On the other hand, when the CPU 10 judges at the above step S82 that the musical note data is equal to the end mark, another check is made as to whether or not the ending pattern is being processed at a step S85. At this stage, when the CPU 10 judges that the ending pattern is not being processed, the basic process operation is carried out at a step S86. This basic process operation is identical to the above-described process operations defined at the step S35 and the step S36. Thereafter, the sequence operation is returned to the previous step S80. As a result, in such a case that the end data is detected while the automatic accompaniment is carried out by the basic variation and the intro-/fill-in variation, the basic musical play is continuously carried out. On the other hand, when the CPU judges that the ending pattern is being processed at the step S85, the automatic musical playing flag AUTO is cleared to "0" at a step S87. Thereafter, the sequence operation is returned from this automatic musical playing process routine to the main process routine. As a consequence, it is possible to realize such a function capable of stopping the automatic accompaniment after the ending musical play has been carried out.

As previously described in detail, in accordance with the automatic accompanying apparatus/method of the present invention, the automatic accompaniment which is made coincident with the motif of the music player over the entire music can be carried out. Moreover, such an automatic accompanying apparatus and automatic accompanying method, capable of simply setting various parameters, which should be performed before the musical play, can be provided.

What is claimed is:

1. An automatic accompanying apparatus comprising:

a part setting section setting a part structure of each of a plurality of basic variation patterns used as a basic accompaniment pattern of one rhythm;

a basic variation pattern selecting section selecting one of said plurality of basic variation patterns;

a part determining section automatically determining a part structure of an auxiliary pattern used as an auxiliary accompaniment pattern of said rhythm such that the part structure of an auxiliary pattern is equal to the part structure of the basic variation pattern selected by said basic variation pattern selecting section; and an automatic accompanying section executing an automatic accompaniment in accordance with the basic variation pattern selected by said basic variation pattern selecting section and the auxiliary pattern having the part structure determined by said part determining section.

2. An automatic accompanying apparatus according to claim 1, wherein said part setting section includes:

an edit selection switch selecting one of said plurality of basic variation patterns to be edited; and a part setting switch designating whether or not each of a plurality of parts of the basic variation pattern selected by said edit selection switch should be muted.

3. An automatic accompanying apparatus according to claim 2, wherein said part setting section further comprises a display unit displaying whether or not each of said plurality of parts of the basic variation pattern selected by said edit selection switch is muted.

4. An automatic accompanying apparatus according to claim 3, wherein said plurality of parts contain a drum part, a bass part, a first accompaniment part, a second accompaniment part, and a third accompaniment part.

5. An automatic accompanying apparatus according to claim 1, wherein said basic variation pattern selecting section includes a plurality of switches corresponding to the plurality of basic variation patterns, respectively.

6. An automatic accompanying apparatus according to claim 1, wherein said auxiliary pattern contains an intro-pattern used to perform an intro-musical play, an ending pattern used to perform an ending musical play, and a fill-in pattern used to perform a fill-in musical play, said part determining section determines a part structure of said intro-pattern such that the part structure of said intro-pattern is equal to a part structure of a basic variation pattern which is played after a musical play is accomplished based on said intro-pattern; and determines a part structure of said fill-in-pattern such that the part structure of said fill-in-pattern is equal to a part structure of a basic variation pattern which is played after a musical play is accomplished based on said fill-in pattern; and determines a part structure of said ending pattern such that the part structure of said ending pattern is equal to a part structure of a basic variation pattern which is played before a musical play is commenced based on said ending pattern.

7. An automatic accompanying apparatus according to claim 6, wherein said part setting section includes:

an edit selection switch selecting one of said plurality of basic variation patterns to be edited; and a part setting switch designating whether or not each of a plurality of parts of the basic variation pattern selected by said edit selection switch should be muted.

8. An automatic accompanying apparatus according to claim 7, wherein said part setting section is further comprises a display unit displaying whether or not each of said plurality of parts of the basic variation pattern selected by said edit selection switch is muted.

9. An automatic accompanying apparatus according to claim 8, wherein said plurality of parts contain a drum part, a bass part, a first accompaniment part, a second accompaniment part, and a third accompaniment part.

10. An automatic accompanying apparatus according to claim 6, wherein said basic variation pattern selecting section includes a plurality of switches corresponding to the plurality of basic variation patterns, respectively.

11. An automatic accompanying method comprising:

(a) setting a part structure of each of a plurality of basic variation patterns used as a basic accompaniment pattern of one rhythm;

(b) selecting one of said plurality of basic variation patterns;

(c) automatically determining a part structure of an auxiliary pattern used as an auxiliary accompaniment pattern of said rhythm such that the part structure of an auxiliary pattern is equal to the part structure of the basic variation pattern selected by said step (b); and (d) executing an automatic accompaniment in accordance with the basic variation pattern selected by said step (b) and the auxiliary pattern having the part structure determined by said step (c).

12. An automatic accompanying method according to claim 11, wherein said step (a) comprises:

(e) selecting one of said plurality of basic variation patterns to be edited; and (f) designating whether or not each of a plurality of parts of the basic variation pattern selected by said step (e) is muted.

13. An automatic accompanying method according to claim 12, wherein said step (c) further comprises:

displaying whether or not each of said plurality of parts of the basic variation pattern selected by said step (e) is muted.

14. An automatic accompanying method according to claim 13, wherein said plurality of parts contain a drum part, a bass part, a first accompaniment part, a second accompaniment part, and a third accompaniment part.

15. An automatic accompanying method according to claim 11, wherein said auxiliary pattern contains an intro-pattern used to perform an intro-musical play, an ending pattern used to perform an ending musical play, and a fill-in pattern used to perform a fill-in musical play, and wherein said step (c) comprises:

determining a part structure of said intro-pattern such that the part structure of said intro-pattern is equal to a part structure of a basic variation pattern which is played after a musical play is accomplished based on said intro-pattern;

determining a part structure of said fill-in-pattern is equal to a part structure of a basic variation pattern which is played after a musical play is accomplished based on said fill-in pattern; and determining a part structure of said ending pattern such that the part structure of said ending pattern is equal to a part structure of a basic variation pattern which is played before a musical play is commenced based on said ending pattern.

16. An automatic accompanying method according to claim 15, wherein said step (a) includes:

(g) selecting one of said plurality of basic variation patterns to be edited; and (h) designating whether or not each of a plurality of parts of the basic variation pattern selected by said step (g) should be muted.

17. An automatic accompanying method according to claim 16, wherein said step (a) further comprises:

displaying whether or not each of said plurality of parts of the basic variation pattern selected by said step (g) is muted.

18. An automatic accompanying method according to claim 17, wherein said plurality of parts contain a drum part, a bass part, a first accompaniment part, a second accompaniment part, and a third accompaniment part.

* * * * *